US012330862B2

(12) United States Patent
Brown et al.

(10) Patent No.: US 12,330,862 B2
(45) Date of Patent: Jun. 17, 2025

(54) SINGLE SERVING BEVERAGE PREPARATION CUP

(71) Applicant: Tower Coffee, Inc., Bend, OR (US)

(72) Inventors: Robert Brown, Bend, OR (US); Brent Patterson, Bend, OR (US)

(73) Assignee: Tower Coffee, Inc., Bend, OR (US)

( * ) Notice: Subject to any disclaimer, the term of this patent is extended or adjusted under 35 U.S.C. 154(b) by 84 days.

(21) Appl. No.: 18/133,907

(22) Filed: Apr. 12, 2023

(65) Prior Publication Data

US 2023/0322430 A1 Oct. 12, 2023

Related U.S. Application Data

(60) Provisional application No. 63/330,285, filed on Apr. 12, 2022.

(51) Int. Cl.
*B65D 85/804* (2006.01)
*B65D 1/26* (2006.01)
*B65D 1/46* (2006.01)

(52) U.S. Cl.
CPC ..... *B65D 85/8055* (2020.05); *B65D 1/265* (2013.01); *B65D 1/46* (2013.01); *B65D 85/8043* (2013.01)

(58) Field of Classification Search
CPC . B65D 1/265; B65D 1/42; B65D 1/46; B65D 3/28–30
USPC ..... 229/400, 406
See application file for complete search history.

(56) References Cited

U.S. PATENT DOCUMENTS 2,563,352 A * 8/1951 Morse ..... B65D 81/3869 220/592.2
2008/0132864 A1* 6/2008 Lawson ..... A61F 13/5638 604/367
2012/0205430 A1* 8/2012 Dickert ..... B65D 3/28 220/738
2017/0042362 A1* 2/2017 Bunner ..... B65D 21/0233
2022/0041318 A1* 2/2022 Liming ..... B65D 21/02

FOREIGN PATENT DOCUMENTS

CN 216090091 U * 3/2022
KR 20190063464 A * 6/2019
WO WO-2016012562 A1 * 1/2016 ..... A47J 31/0642
WO WO-2018068869 A1 * 4/2018

* cited by examiner

*Primary Examiner* — Nathan J Newhouse
*Assistant Examiner* — Phillip D Schmidt
(74) *Attorney, Agent, or Firm* — Sheppard Mullin Richter & Hampton LLP

(57) ABSTRACT

Systems and methods for a single serving beverage preparation cup are provided. The single serving beverage preparation cup may include a plurality of reverse teardrop ribs that may channel water combined with dried ingredients, for example coffee grounds, through the single serving beverage preparation cup. By channeling the combined water and dried ingredients through the single serving beverage preparation cup, the pressure within the single serving beverage preparation cup is reduced, an avenue for extraction is created, varying amounts of dried ingredients can be added, and water may be exposed to a greater proportion of dried ingredients than in conventional systems.

20 Claims, 6 Drawing Sheets

SINGLE SERVING BEVERAGE PREPARATION CUP

RELATED APPLICATIONS

This application claims the benefit of U.S. Provisional Patent Application No. 63/330,285, filed Apr. 12, 2022, the content of which is incorporated herein by reference in its entirety.

TECHNICAL FIELD

The present disclosure relates generally to systems and methods for a single serving beverage preparation cup. In particular, some implementations may relate to a single serving beverage preparation cup with reverse teardrop ribs.

BACKGROUND

Single serving beverage preparation cups allow for individuals to brew a single cup of coffee or other beverage without utilizing traditional methods of brewing, such as boiling water, grinding beans, using a coffee maker, espresso maker, or similar coffee brewing apparatuses. Conventional single serving beverage preparation cups are made from plastic, with rounded walls, that hold a filter, which can be filled with dried ingredients, such as coffee grounds, tea leaves, chocolate powder, and similar ingredients for brewed drinks. These conventional single serving beverage preparation cups can be placed in a brewing machine (e.g., a Keurig machine) where a feature of the machine punctures a seal on the top of the cup, dispenses water, often hot or boiling, over the dried ingredients in the cup, and then allows the water mixed with dried ingredients to pass through the filter and drain into a cup placed below a spout or nozzle on the brewing machine. Conventional single serving beverage preparation cups are limited by the amount of dried ingredients that fit inside the filter, the speed with which the combined water and dried ingredients drain through the filter, and the limited space for extraction along the wall of the cup. Better systems are needed.

SUMMARY

Systems and methods are described herein for a single serving beverage preparation cup with a frustoconical shaped body formed by reverse teardrop ribs. In various embodiments, the frustoconical shaped body may have an exterior wall that is lined with a plurality of reverse teardrop ribs, disposed in parallel, vertically offset, and spaced apart from one another. The frustoconical shaped body may further have an opening and a base. The opening of the frustoconical shaped body may have a greater diameter than the base. In embodiments, the opening of the frustoconical shaped body may have a lip member that lines the circumference of the opening, and further extends perpendicularly beyond the frustoconical shaped body. In between the lip member and the frustoconical shaped body there may be a separation member. On the opposite side of the opening of the frustoconical shaped body, there may be a base, which may include a plurality of apertures of a particular diameter extending over the entirety of the base.

In various embodiments, each reverse teardrop rib of the plurality of reverse teardrop ribs may have a first end, which is rounded, and a second end, which is pointed. The first end and second end may be vertically offset, such that each rib of the plurality of ribs, curves around the exterior wall of the frustoconical shaped body, or each rib of the plurality of ribs may have vertical such that the plurality of ribs sit perpendicular to the opening of the cup. Further, each reverse teardrop rib of the plurality of reverse teardrop ribs an interior portion, extending perpendicularly in from the surface of the interior wall of the frustoconical shaped body, and a depressed portion concave into the exterior wall of the frustoconical shaped body.

In further embodiments, the single serving beverage preparation cup may be filled with dried ingredients and covered with a sealing layer. The single serving beverage preparation cup may be placed in a brewing machine or brewing apparatus that punctures the sealing layer and forces water into the cup. The water may combine with the dried ingredients and then be channeled through the single serving beverage preparation cup in a vortex-like or oscillating manner, exposing the water to a greater surface area of dried ingredients than conventional methods, and channel the water towards the bottom of the cup reducing pressure in the cup and decreasing brew time.

Other features and aspects of the disclosure will become apparent from the following detailed description, taken in conjunction with the accompanying drawings, which illustrate, by way of example, the features in accordance with various embodiments. The summary is not intended to limit the scope of the invention, which is defined solely by the claims attached hereto.

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

The figures are not intended to be exhaustive or to limit the invention to the precise form disclosed. It should be understood that the invention can be practiced with modification and alteration, and that the disclosed technology be limited only by the claims and the equivalents thereof.

DETAILED DESCRIPTION

Single serving beverage preparation cups have changed the way people prepare beverages. For example, the addition of single serving beverage preparation cups have granted more people access to home-brewed coffee than traditional methods had previously allowed. Often, traditional brewing methods such as boiling water, grinding beans, using a coffee maker, espresso maker, or similar coffee brewing apparatuses, require individuals to have some fundamental knowledge of how to prepare their beverage. Additionally, they require individuals to take time to brew their beverage, which may dissuade those with limited time or energy from preparing the beverages they desire. Since single serving beverage preparation cups allow for people to brew a single cup of coffee or other beverage without utilizing traditional methods of brewing, they allow for more people to have their beverage of choice in a timeframe suitable to their lifestyle.

Generally, single serving beverage preparation cups can be placed in a single serve brewing machine and brew a beverage with a simple press a button. Single serving beverage preparation cups can brew various beverages including coffee, tea, espresso, hot chocolate, and other beverages brewed from dried ingredients. Conventional single serving beverage preparation cups are made from plastic, with rounded walls that hold a filter, which can be filled with dried ingredients. While conventional single serving beverage preparation cups allow for various methods of brewing beverages, they are limited by the amount of dried ingredients that can be placed in the single serving beverage preparation cup, the speed with which the water combines with the dried ingredients and drains from the cup, and the limited space between the filter and the wall of the cup for extraction. Moreover, large portions of the dried ingredients are wasted because the water poured into the cup drains directly down through the cup without moving laterally therein, this leaves portions of the dried ingredients untouched by the water within the cup.

Figure 1:
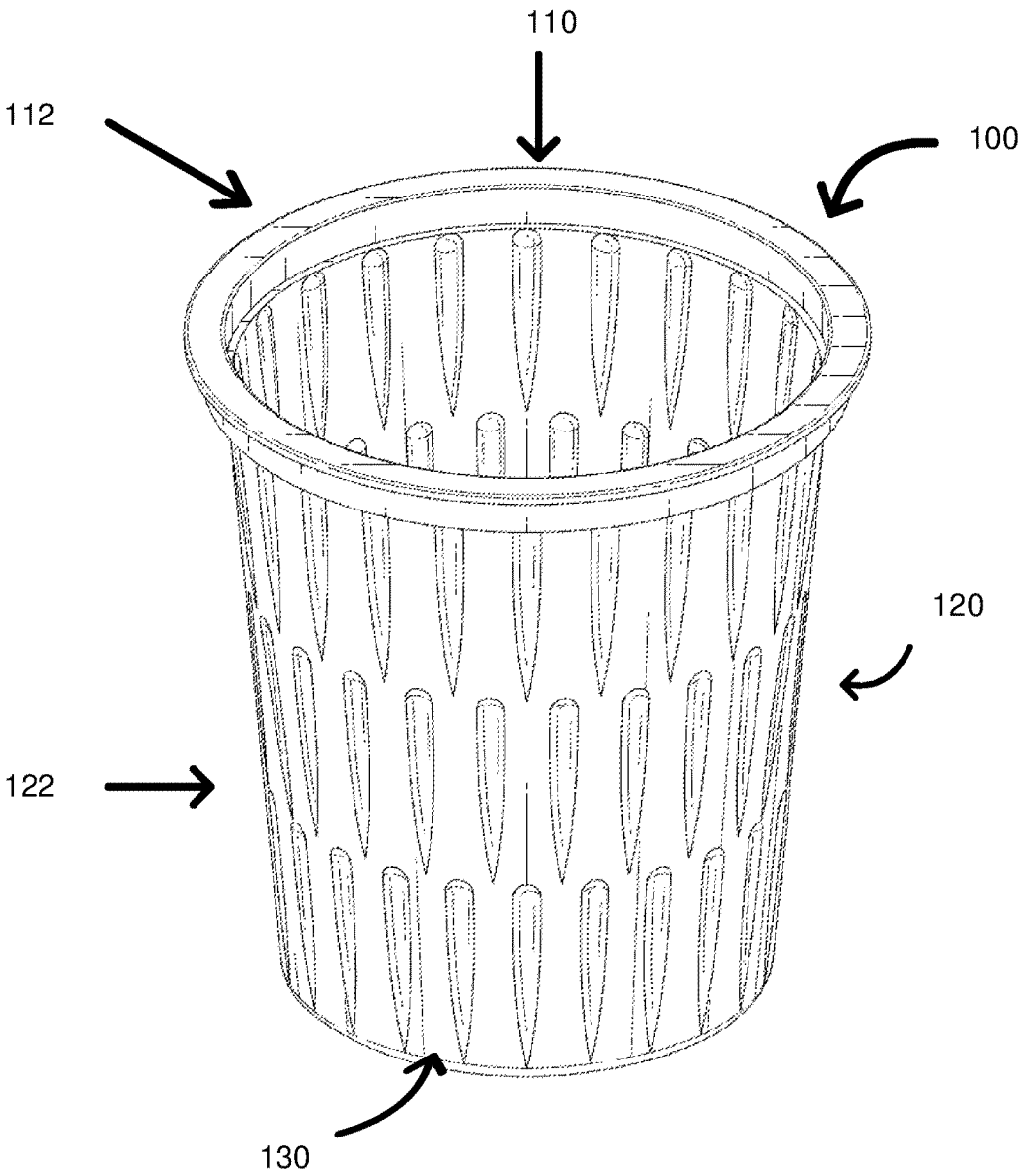
FIG. 1 is a perspective view of an example of a single serving beverage preparation cup, according to embodiments of the present disclosure.
Figure 2:
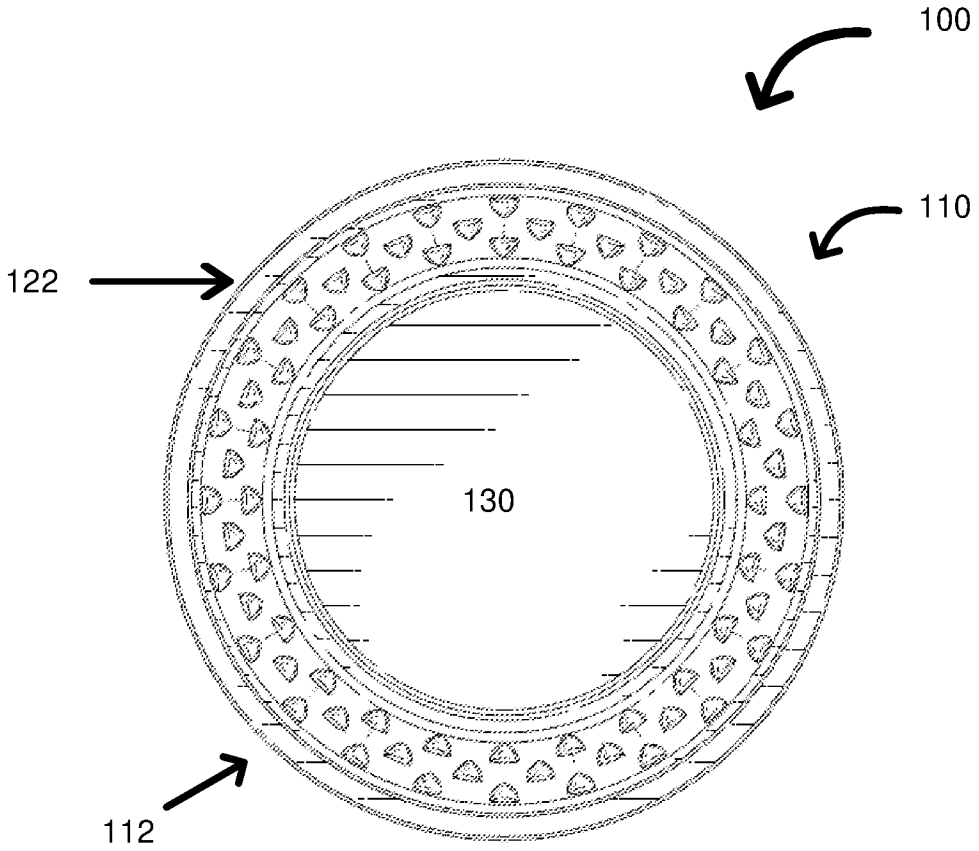
FIG. 2 is a top view of an example of a single serving beverage preparation cup, according to embodiments of the present disclosure.

The instant single serving beverage preparation cup provides a novel solution to this problem via its frustoconical shaped body formed by a plurality of reverse teardrop ribs that channel water from an opening at the top of the cup, to the base of the cup, while simultaneously creating a vortex or oscillating effect within the cup allowing the water to come into greater contact with dried ingredients during the brewing process than conventional single serve cups. Moreover, the addition of the plurality of reverse teardrop ribs provides an avenue for extraction along the interior wall of the single serving beverage preparation cup when the filter expands under pressure during brewing. Additionally, the addition of the plurality of reverse teardrop ribs improves the cups' ability to be stacked for storage, transportation, or the like FIGS. 1-2 illustrate an example perspective and top view of a single serving beverage preparation cup, according to embodiments of the present disclosure. In various embodiments, a single serving beverage preparation cup 100 is provided. The single serving beverage preparation cup 100 may be used to brew beverages from dried ingredients in a similar manner as conventional single serving beverage preparation cups. However, the claimed single serving beverage preparation cup 100 may have a frustoconical shaped body 120 (e.g., frustoconical may mean a truncated cone), with a plurality of reverse teardrop ribs 122. In various embodiments, the frustoconical shaped body 120 may help channel the water through the single serving beverage preparation cup 100 by directing water from an opening 110 to a base 130.

In some embodiments of the claimed single serving beverage preparation cup 100, the frustoconical shaped body 120 may have a plurality of tear-drop shaped indentations or reverse teardrop ribs 122. The reverse teardrop ribs 122 may direct water mixed with dried ingredients through the interior if the cup 100. The reverse teardrop ribs 122 may be separated uniformly or non-uniformly on the wall of the frustoconical shaped body 120. The reverse teardrop ribs 122 may be depressed toward the interior of the frustoconical shaped body such that they create indentations on the exterior of the cup and protrusions on the interior of the cup. In this embodiment, the single-serving beverage preparation cup 100 may comprise between 10 and 100 tear-drop shaped indentations. This number is not meant to be limiting, but rather merely exemplary.

Each tear-drop shaped indentations may have two ends, wherein each tear-drop shaped indentation extends vertically a discrete distance. In other embodiments, the tear-drop shaped indentations may be angled or otherwise positions to further direct the flow of liquid inside the cup. The tear-drop shaped indentations may be lined above/below one another, and/or side-by-side, such that the tear-drop shaped indentations form a grip on the wall of the frustoconical shaped body. In other embodiments, the tear-drop shaped indentations may be placed in a non-uniform manner in any combination that provides for liquid movement in the single serving beverage preparation cup.

As discussed, the plurality of reverse teardrop ribs 122 may be formed into the frustoconical shaped body 120 such that the plurality of reverse teardrop ribs forms an exterior wall, which is disposed on the outside of the single serving beverage preparation cup 100, and an interior wall which is disposed on the inner portion of the frustoconical shaped cup 100. The exterior wall and the interior wall are disposed upon one another and share an internal structure. For example, if the exterior wall is raised by 1 cm, the coordinating portion of the interior wall will be depressed 1 cm. In various embodiments, the combination of raised portions and lowered portions of the plurality of reverse teardrop ribs may form some or all of the exterior and interior walls. The plurality of reverse teardrop ribs may be disposed in parallel around the frustoconical shaped body 120. The distance between the raised portions 122 of each individual rib may be uniform or varied. For example, the distance between the raised portion 122 on the upper area of the single serving beverage preparation cup may be 1 cm, while the distance between the raised portions 122 on the lower area of the cup may be 0.7 cm. In further embodiments, the distance between the raised portions 122 and the lower portion 124 may be the same or different. For example, the width of the raised portion 122 may be 1 cm and the width of the lowered portion 124 may be 1 cm. In another example, the width of the raised portion 122 may 2 cm and the width of the lowered portion may be 0.2 cm. Other variations in widths and separations may be possible, the prior discussed examples are merely exemplary and not meant to limit the scope of the disclosure, which is solely limited by the claims. In other embodiments, the raised ribs may be uniformly spaced over the entirety of the frustoconical shaped body 120.

Figure 3:
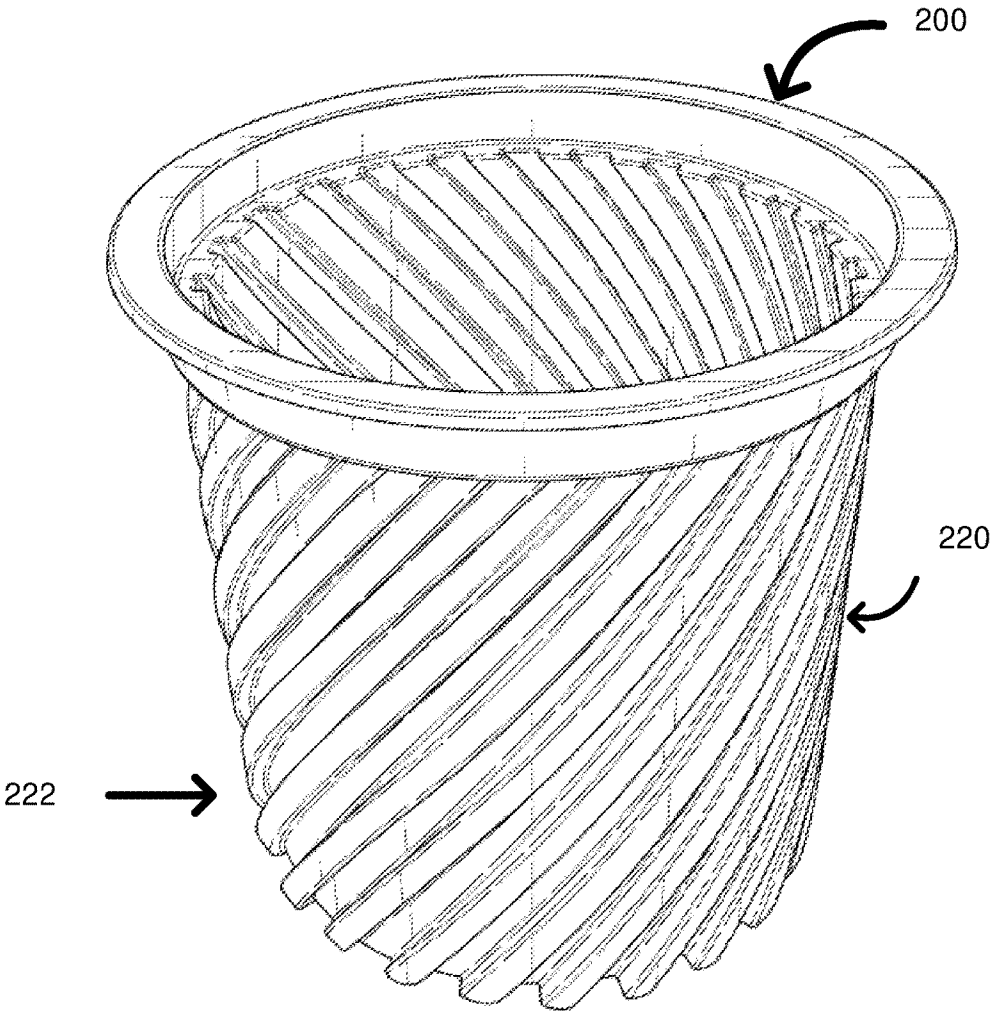
FIG. 3 is another perspective view of an example of a single serving beverage preparation cup, according to embodiments of the present disclosure.

Each reverse teardrop rib of the plurality of reverse teardrop ribs may have two ends, wherein a first end, which is rounded sits above a second end, which is pointed. The first end my be connected to the separation member 114 on the reverse teardrop ribs connected to the separation member (discussed below) and the second end may be connected to the base 130 for reverse teardrop ribs that are connected to base. In various embodiments, the first end and second end may sit vertically on top of each other such that the ribs run perpendicular to the opening 110 of the single serving beverage preparation cup 100. In other embodiments, each rib may be disposed at an angle, where the first end and second end are vertically offset, as depicted in FIG. 3. In the FIG. 3 example, each diagonally positioned raised rib curls around the frustoconical body, such that each rib is curved in relation to the curvature of the frustoconical shaped body 120.

The plurality of reverse teardrop ribs may be angled in relation to the orthogonal direction of the frustoconical shaped body 120. For example, when the plurality of ribs are vertical, they may be vertically offset by 0 degrees, such that water may be channeled downward with little to no lateral movement. In another example, the plurality of ribs may be angled 45 degrees, such that water may be channel both downward and laterally. In various embodiments, the plurality of ribs may be angled from 0 degrees to 90 degrees.

The plurality of ribs may alternate between raised 122 and the wall of the frustoconical body 120, such that each reverse teardrop rib is positioned adjacent to a lowered section 124. Raised may be viewed from the perspective of the exterior wall of the frustoconical shaped body 120 and may also be considered an interior portion of the rib. The raised reverse teardrop ribs are mirrored on the exterior wall of the frustoconical shaped body 120 by a depression in the frustoconical shaped body. The interior wall of the frustoconical shaped body 120 may be the area where a filter is placed and where the combined water and dried ingredients are channeled.

The frustoconical shaped body 120 may have an opening 110 and a base 130. In various embodiments, the diameter of the opening 110 may have be greater than the diameter of the base 130. For example, the opening 110 of the frustoconical shaped body may be 5 centimeters (cm), whereas the base 130 may be 4 cm. Additionally, the walls of the frustoconical shaped body may be angled in relation to vertical by having different diameters of the opening and base. For example, the angle of the wall of the frustoconical shaped body may range from 0 degrees from vertical to 15 degrees from vertical. Other angles are also possible.

The opening 110 of the frustoconical shaped body 120 may be disposed on one end of the single serving beverage preparation cup 100. For example, as depicted in FIG. 1, the opening 110 may be on the top of the single serving beverage preparation cup 100. The opening may have a lip member 112 that lines the circumference of the opening 110. In some embodiments, the lip member 112 may extend outwards from the opening 110, such that the lip member 112 forms an overhang extended perpendicularly beyond the exterior of the frustoconical shaped body 120. For example, the lip member 112 may have a width of 4 cm, of which, 2 cm extends perpendicularly past the exterior of the frustoconical shaped body 120. The lip member may range from 0.1 cm to 5 cm, and may extend beyond the exterior of the frustoconical shaped body 120 by 0 cm to 3 cm. In other embodiments, the lip member 112 may extend at an angle beyond the frustoconical shaped body 120.

Below the lip member 112 there may be a separation member 114 that separates the frustoconical shaped body 120 from the lip member 112. The separation member 114 may surround an upper area of the frustoconical shaped body 120, such that a smooth ring is formed that separates the lip member 112 from the frustoconical shaped body 120. The separation member 114 may be 0.1 cm to 5 cm in height and may surround all or a portion of the underbody of the lip member 112 and an upper portion of the frustoconical shaped body 120. In various embodiments, the separation member 114 may allow for the single serving beverage preparation cups 100 to be stacked because they provide space for the lip member 112 of a first single serving beverage preparation cup 100 to rest when a second single serving beverage preparation cup 100 is placed therein.

The frustoconical shaped body 120 may have a base 130. The base 130 may be disposed on the smaller diameter side of the frustoconical shaped body 120. In some embodiments, the base 130 may be predominantly flat. In other embodiments, the base 130 may be surrounding by a rim (not illustrated) that allows the center of the base to be elevated from the lowest structural feature of the base. For example, the base 130 may have a ridge resembling a donut along the circumference of the base that raises the base from a surface or machine that the single serving beverage preparation cup 100 is disposed on.

In various embodiments, the base may comprise a plurality of apertures that can allow the combined water and dried ingredients to escape the single serving beverage preparation cup 100. The apertures may be spaced uniformly or dispersed in organized or non-organized patterns. For example, the apertures may extend uniformly over the entirety of the base 130. The apertures may range in diameter from 0.1 millimeters (mm) to 2 mm. There may be anywhere from 1 to 250 apertures on the base 130 of the single serving beverage preparation cup 100.

The frustoconical shaped body 120 may be disposed in between the opening 110 and the base 130, such that the side of the frustoconical shaped body 120 with a greater diameter includes the opening 110 and the side of the frustoconical shaped body 120 with a lesser diameter includes the base 130.

Figure 4:
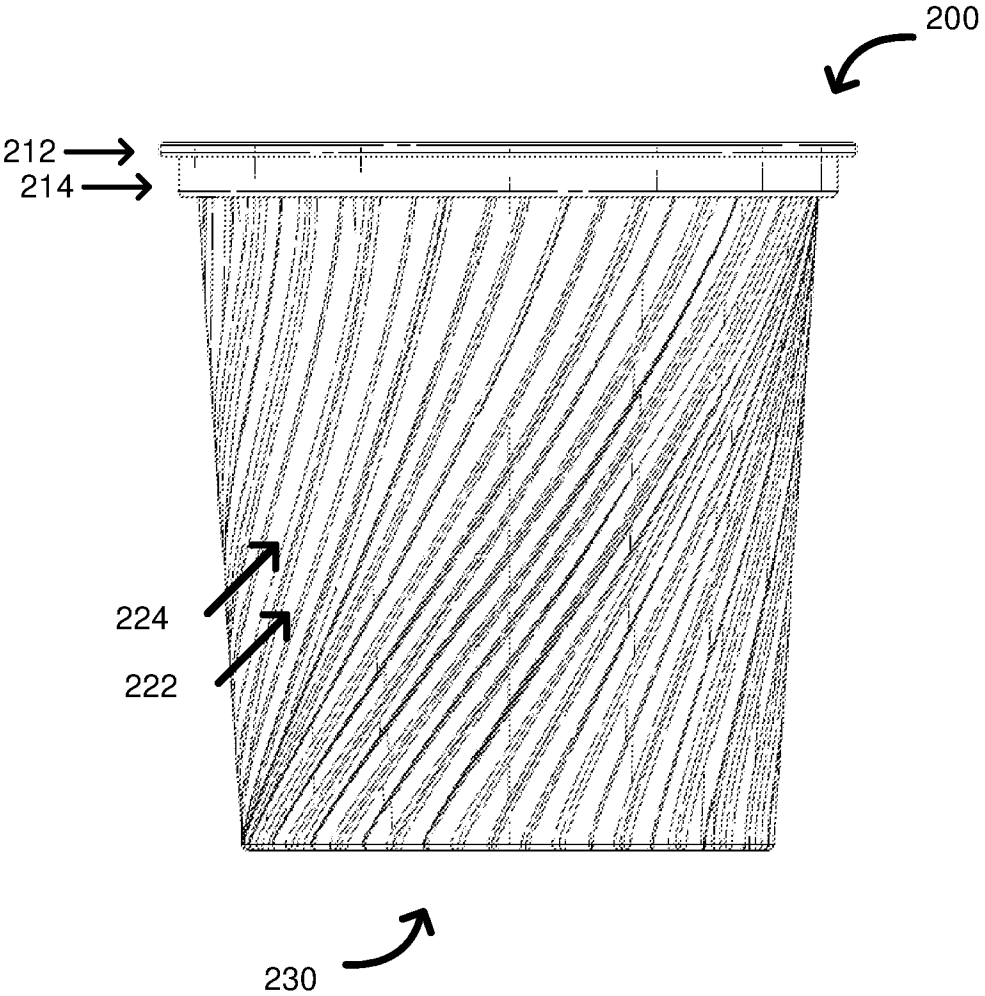
FIG. 4 is a side view of an example of a single serving beverage preparation cup according to embodiments of the present disclosure.
Figure 5:
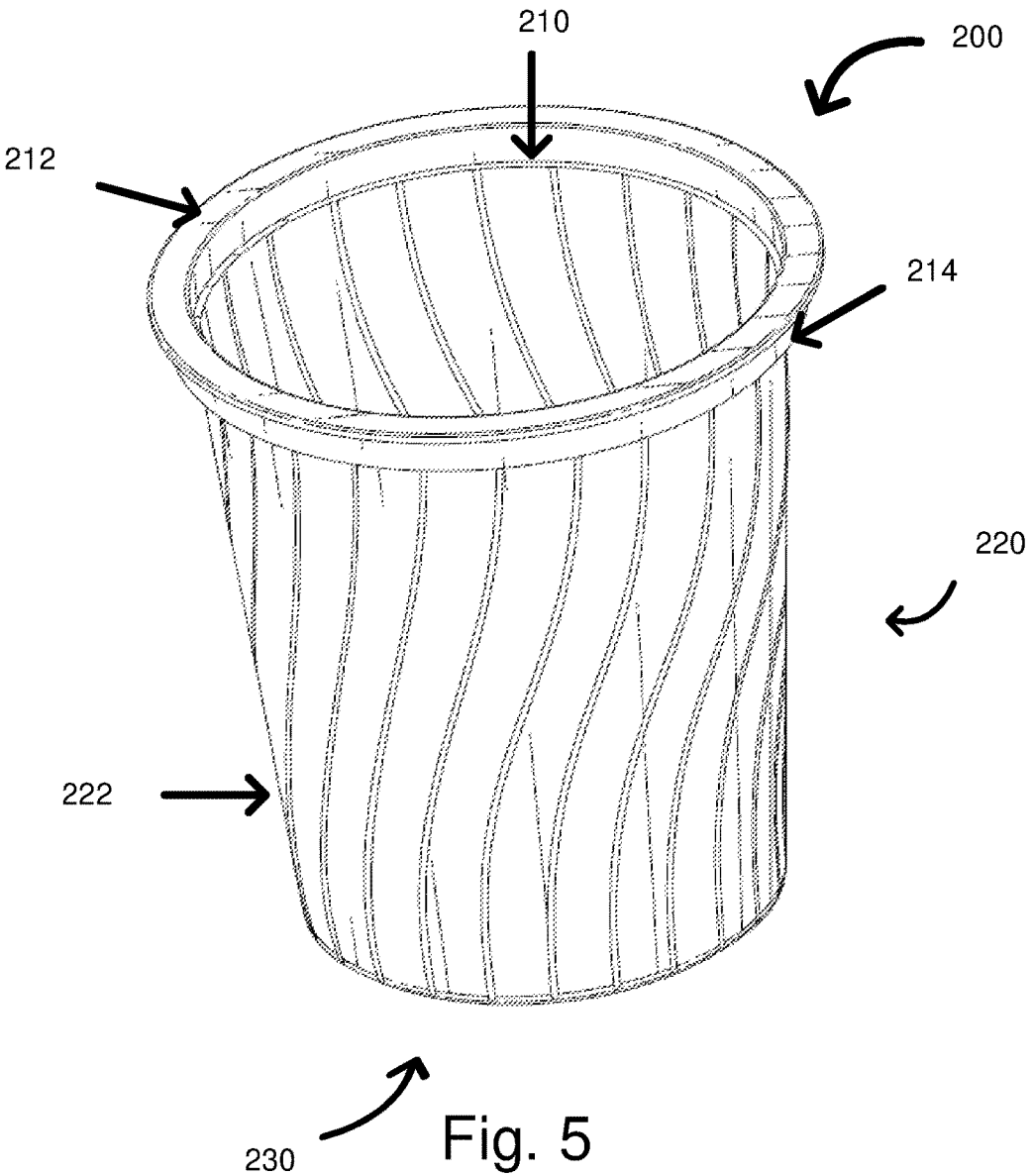
FIG. 5 is another perspective view of an example of a single serving beverage preparation cup, according to embodiments of the present disclosure.

FIGS. 3-5 are another perspective view and side-view of an example of a single serving beverage preparation cup, according to embodiments of the present disclosure. In various embodiments, a single serving beverage preparation cup 200, as depicted by FIG. 4, which may have similar features as embodiments depicted in FIGS. 1-2. However, in some embodiments of the claimed single serving beverage preparation cup 200 the frustoconical shaped body 220 (e.g., frustoconical may mean a truncated cone), with a plurality of diagonally positioned raised ribs 222, may have raised ribs that are linear, curved, and/or sinusoidal (as depicted in FIGS. 2-6).

In embodiments, the diagonally positioned raised ribs 222 may be formed into the frustoconical shaped body 220 such that the plurality of diagonally positioned raised ribs forms an exterior wall, which is disposed on the outside of the single serving beverage preparation cup 200, and an interior wall which is disposed on the inner portion of the frustoconical shaped cup 200. The diagonally positioned raised ribs may be disposed in parallel around the frustoconical shaped body 220. The distance between the raised portions of each individual rib may be uniform or varied. In some embodiments, the raised ribs may form any portion of a plurality of sinusoidal waves along the exterior wall of the frustoconical shaped body. For example, the upper portion of the raised rib may be perpendicular or nearly perpendicular with the separation member, the lower portion may be perpendicular or nearly perpendicular with the base, and the center may be curved such that the upper portion and lower portion of vertically offset.

Each diagonally positioned raised rib of the plurality of diagonally positioned raised ribs may have two ends, wherein each rib extends from a base 230 of the frustoconical shaped body 220 to a separation member 214. A first end or upper portion may be connected to the separation member 214 and the second end or lower portion may be connected to the base 230. In various embodiments, the first end and second end may sit vertically on top of each other such that the ribs run perpendicular to the opening 210 of the single serving beverage preparation cup 200. In other embodiments, each rib may be disposed at an angle, where the first end and second end are vertically offset, as depicted in FIG. 3. In this example, each diagonally positioned raised rib curls around the frustoconical body, such that each rib is curved in relation to both the curvature of the frustoconical shaped body 220 and the raised rib itself.

The plurality of ribs may alternate between raised 222 and lowered sections 224, such that each raised ribs is positioned adjacent to a lowered section. Raised and lowered are viewed from the perspective of the exterior wall (as opposed to the interior wall of FIGS. 1-2) of the frustoconical shaped body 220. The raised and lowered ribs are mirrored on the interior wall of the frustoconical shaped body 220. The interior wall of the frustoconical shaped body 220 may be the area where a filter is placed and where the combined water and dried ingredients are channeled. For example, the raised rib may extend around a greater portion of the frustoconical shaped body than the lowered section. In this example, the raised section may be 1-2 cm wide, and the lowered section may be 0.1-0.3 cm wide.

The frustoconical shaped body 220 may have an opening 210 and a base 230. In various embodiments, the diameter of the opening 210 may have be greater than the diameter of the base 230. For example, the opening 210 of the frustoconical shaped body may be 5 centimeters (cm), whereas the base 230 may be 4 cm. The combination of frustoconical shaped body 220 and plurality of diagonally positioned raised ribs may create an auger-like structure. Additionally, the walls of the frustoconical shaped body may be angled in relation to vertical by having different diameters of the opening and base. For example, the angle of the wall of the frustoconical shaped body may range from 0 degrees from vertical to 15 degrees from vertical. Other angles are also possible.

Figure 6:
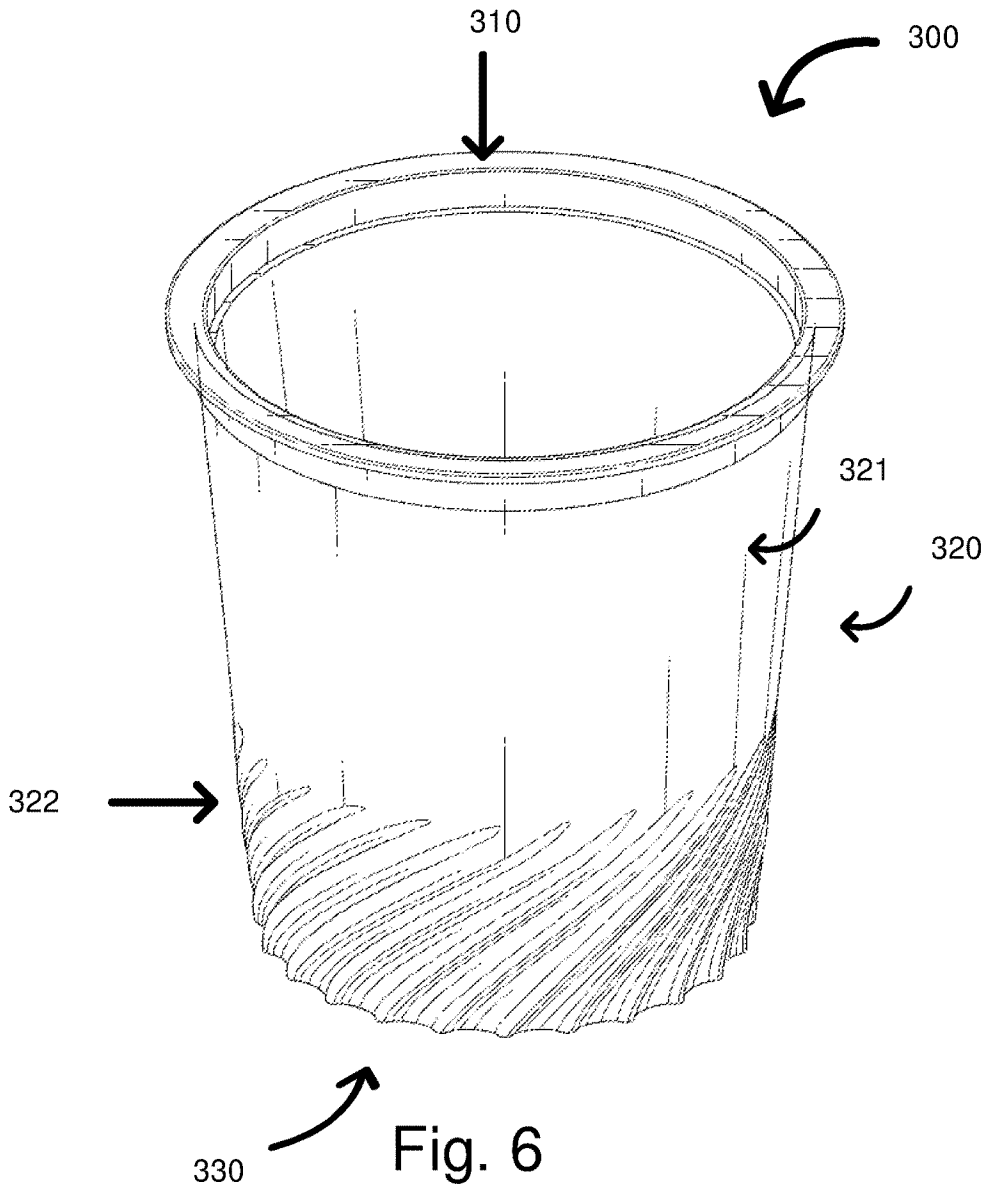
FIG. 6 is another perspective view of an example of a single serving beverage preparation cup, according to embodiments of the present disclosure.

FIG. 6 is another perspective view of an example of a single serving beverage preparation cup, according to embodiments of the present disclosure. In various embodiments, a single serving beverage preparation cup 300, as depicted by FIG. 5, may have similar features as embodiments depicted in FIGS. 1-4. However, in some embodiments of the claimed single serving beverage preparation cup 300 the frustoconical shaped body 320 (e.g., frustoconical may mean a truncated cone), with a plurality of diagonally positioned raised ribs 322, may have raised ribs that are linear, curved, and/or sinusoidal only on a lower portion of the frustoconical shaped body 320, such that a portion of the frustoconical shaped body is without ribs 321 (as depicted in FIG. 5).

In embodiments, the diagonally positioned raised ribs 322 may be formed into the lower portion of the frustoconical shaped body 320 such that the plurality of diagonally positioned raised ribs form an exterior wall, which is disposed on the outside of the single serving beverage preparation cup 300, and an interior wall which is disposed on the inner portion of the frustoconical shaped cup 300. The diagonally positioned raised ribs may be disposed in parallel around the lower portion of the frustoconical shaped body 320. The distance between the raised portions of each individual rib may be uniform or varied. In some embodiments, the raised ribs may form any portion of a plurality of sinusoidal waves along the exterior wall of the frustoconical shaped body. For example, the upper portion of the raised rib may be perpendicular or nearly perpendicular with the separation member, the lower portion may be perpendicular or nearly perpendicular with the base, and the center may be curved such that the upper portion and lower portion of vertically offset.

Each diagonally positioned raised rib of the plurality of diagonally positioned raised ribs may have two ends, wherein each rib extends from a base 330 of the frustoconical shaped body 320 to the planer, rounded, or flat upper portion 321 of the frustoconical shaped body 320. A first end or upper portion may be connected to the upper portion 321 of the frustoconical shaped body 320 and the second end or lower portion may be connected to the base 330. In various embodiments, the first end and second end may sit vertically on top of each other such that the ribs run perpendicular to the opening 310 of the single serving beverage preparation cup 300. In other embodiments, each rib may be disposed at an angle, where the first end and second end are vertically offset, as depicted in FIG. 5. In this example, each diagonally positioned raised rib curls around the frustoconical body, such that each rib is curved in relation to both the curvature of the frustoconical shaped body 320 and the raised rib itself.

The frustoconical shaped body 320 may have an opening 310 and a base 330. In various embodiments, the diameter of the opening 310 may have be greater than the diameter of the base 330. For example, the opening 310 of the frustoconical shaped body may be 5 centimeters (cm), whereas the base 330 may be 4 cm. The combination of frustoconical shaped body 320 and plurality of diagonally positioned raised ribs may create an auger-like structure. Additionally, the walls of the frustoconical shaped body may be angled in relation to vertical by having different diameters of the opening and base. For example, the angle of the wall of the frustoconical shaped body may range from 0 degrees from vertical to 15 degrees from vertical. Other angles are also possible.

The single serving beverage preparation cup 100, 200, 300, 400 may be used to prepare beverages by placing dried ingredients into the interior of the frustoconical shaped body. For example, coffee beans may be ground using known methods and the ground coffee may be placed into the interior of the single serving beverage preparation cup. In some embodiments, there may first be a filter placed in the interior of the single serving beverage preparation cup, in which the coffee or dried ingredients may be disposed. The dried ingredients may be contained in the interior of the frustoconical shaped body by having the interior wall closed and perpendicularly connected to the base. Additionally, the single serving beverage preparation cup may have a sealing layer that is secured over the opening, to further prevent the dried ingredients from leaving the single serving beverage preparation cup during storage.

The single serving beverage preparation cup may have water poured into the opening of the cup, once dried ingredients are placed in the interior, to brew or make a beverage. If the single serving beverage preparation cup has a sealing layer installed over the opening, a puncturing mechanism may be used to open a hole in the sealing layer, to then dispense water through. The geometry of the plurality of diagonally positioned raised ribs catches and channels the water towards the bottom of the frustoconical shaped body, such that the combined water and dried ingredients form a vortex. For example, when coffee ground are placed in the interior, a water is dispensed into the single serving beverage preparation cup, the combination may be channeled through the plurality of diagonally positioned raised ribs, such that the combination swirls or forms a vortex as it is directed downward towards the base of the cup. By channeling the combination of water and dried ingredients, the water comes into greater surface contact with dried ingredients because it does not channel directly down from the opening to the base but rather moves in a vortex (with a horizontal or lateral component), forcing the water into greater contact with dried ingredients than conventional single serving cups. For example, in conventional single serving beverage preparation cups, water is dispensed into the cup and touches coffee grounds vertically and gravity pulls the combination towards the bottom of the cup. In the present example, water may move both downward and laterally, which engages the water through a greater number of individual dried ingredients as it moves through the cup.

Further, in conventional single serving beverage preparation systems, the pressure increases in the cup while the beverage is being brewed due to the water pressure exerted by the brewing machine or apparatus dispensing water directly into the cup. The instant single serving beverage preparation cup allows for pressure to be evenly dispersed throughout the cup and allows for an avenue for extraction along the side wall when filter expands under pressure inside the single serving beverage preparation cup.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A single serving beverage preparation cup, comprising: a frustoconical shaped body having an opening and a base, wherein the opening has a greater diameter than the base, the frustoconical shaped body comprising a wall with an interior surface and an exterior surface, both the interior surface and exterior surface being formed by a plurality of reverse teardrop ribs, wherein the plurality of reverse teardrop ribs are vertically offset.

2. The single serving beverage preparation cup of claim 1, wherein the plurality of reverse teardrop ribs are disposed in parallel.

3. The single serving beverage preparation cup of claim 2, wherein the plurality of reverse teardrop ribs are spaced apart from one another.

4. The single serving beverage preparation cup of claim 1, wherein each of the plurality of reverse teardrop ribs comprises a first end, which is rounded, and a second end, which is pointed.

5. The single serving beverage preparation cup of claim 4, wherein each of the plurality of reverse teardrop ribs further comprises an interior portion extending perpendicularly in from the interior surface of the frustoconical shaped body.

6. The single serving beverage preparation cup of claim 5, wherein each of the plurality of reverse teardrop ribs further comprises a depressed portion in the exterior surface of the frustoconical shaped body that corresponds to each interior portion of the plurality of reverse teardrop ribs.

7. The single serving beverage preparation cup of claim 1, wherein the opening includes a lip member lining the circumference of the opening and extending beyond the frustoconical shaped body.

8. The single serving beverage preparation cup of claim 7, wherein the lip member is separated from the frustoconical shaped body by a separation member that separates the frustoconical shaped body from the lip member.

9. The single serving beverage preparation cup of claim 1, wherein the base comprises a plurality of apertures of a predetermined diameter.

10. A single serving beverage preparation cup, comprising:

a frustoconical shaped body having an opening and a base, wherein the opening has a greater diameter than the base, the frustoconical shaped body comprising a wall with an interior surface and an exterior surface, both interior and exterior surfaces being formed by a plurality of reverse teardrop ribs, disposed in parallel, vertically offset, and spaced apart from one another.

11. The single serving beverage preparation cup of claim 10, wherein each of the plurality of reverse teardrop ribs comprises a first end, which is rounded, and a second end, which is pointed.

12. The single serving beverage preparation cup of claim 11, wherein each of the plurality of reverse teardrop ribs further comprises an interior portion extending perpendicularly in from the interior surface of the frustoconical shaped body.

13. The single serving beverage preparation cup of claim 12, wherein each of the plurality of reverse teardrop ribs further comprises a depressed portion in the exterior surface of the frustoconical shaped body that corresponds to each interior portion of the plurality of reverse teardrop ribs.

14. The single serving beverage preparation cup of claim 10, wherein the opening includes a lip member lining the circumference of the opening and extending beyond the frustoconical shaped body.

15. The single serving beverage preparation cup of claim 14, wherein the lip member is separated from the frustoconical shaped body by a separation member that separates the frustoconical shaped body from the lip member.

16. The single serving beverage preparation cup of claim 10, wherein the base comprises a plurality of apertures of a predetermined diameter.

17. A single serving beverage preparation cup, comprising:

a frustoconical shaped body having an opening and a base, wherein the opening has a greater diameter than the base, the frustoconical shaped body comprising a wall with an interior surface and an exterior surface, both interior and exterior surfaces being formed by a plurality of reverse teardrop ribs, disposed in parallel, vertically offset, and spaced apart from one another;

wherein each of the plurality of reverse teardrop ribs comprises a first end, which is rounded, a second end, which is pointed, an interior portion extending perpendicularly in from the interior surface of the frustoconical shaped body, and a depressed portion in the exterior surface of the frustoconical shaped body that corresponds to the interior portion of the plurality of reverse teardrop ribs.

18. The single serving beverage preparation cup of claim 17, wherein the opening includes a lip member lining the circumference of the opening and extending beyond the frustoconical shaped body.

19. The single serving beverage preparation cup of claim 18, wherein the lip member is separated from the frustoconical shaped body by a separation member that separates the frustoconical shaped body from the lip member.

20. The single serving beverage preparation cup of claim 17, wherein the base comprises a plurality of apertures of a predetermined diameter.

* * * * *